US010051392B2

(12) United States Patent
Schmidt et al.

(10) Patent No.: US 10,051,392 B2
(45) Date of Patent: Aug. 14, 2018

(54) HEARING AID CONFIGURATION DETECTION

(71) Applicant: GN HEARING A/S, Ballerup (DK)

(72) Inventors: Flemming Schmidt, Virum (DK); Ebbe Skammelsen, Hoersholm (DK); Andreas Schousboe, Gentofte (DK)

(73) Assignee: GN HEARING A/S, Ballerup (DK)

( * ) Notice: Subject to any disclaimer, the term of this patent is extended or adjusted under 35 U.S.C. 154(b) by 490 days.

(21) Appl. No.: 14/185,632

(22) Filed: Feb. 20, 2014

(65) Prior Publication Data

US 2015/0237450 A1 Aug. 20, 2015

(30) Foreign Application Priority Data

Feb. 17, 2014 (DK) ..... 2014 70077
Feb. 17, 2014 (EP) ..... 14155375

(51) Int. Cl.
*H04R 25/00* (2006.01)

(52) U.S. Cl.
CPC ..... *H04R 25/70* (2013.01); *H04R 25/305* (2013.01)

(58) Field of Classification Search
CPC ..... H04R 25/30; H04R 25/70; H04R 25/305; H04R 25/556; H04R 25/608; H04R 2225/63
See application file for complete search history.

(56) References Cited

U.S. PATENT DOCUMENTS

2008/0008340 A1 1/2008 Bachler et al.
2009/0052706 A1* 2/2009 Gottschalk et al. ..... 381/314
2010/0111315 A1 5/2010 Kroman
2010/0208906 A1 8/2010 Vonlanthen
2010/0272272 A1* 10/2010 Muller et al. ..... 381/60
2013/0251165 A1 9/2013 Jorgensen et al.

FOREIGN PATENT DOCUMENTS

DE 10 2008 030 551 A1 8/2009
EP 2 434 780 A1 3/2012

OTHER PUBLICATIONS

First Technical Examination and Search Report dated Aug. 21, 2014, for related DK Patent Application No. PA 2014 70077, 6 pages.
Extended European Search Report dated Aug. 6, 2014, for related EP Patent Application No. 14155375.0, 6 pages.
Second Technical Examination dated Apr. 29, 2015, for related DK Patent Application No. PA 2014 70077, 3 pages.
European Communication pursuant to Article 94(3) EPC dated Jun. 10, 2016 for corresponding EP Patent Application No. 14155375.0, 5 pages.
European Communication pursuant to Article 94(3) EPC dated Jul. 11, 2017 for corresponding EP Patent Application No. 14155375.0, 7 pages.

* cited by examiner

*Primary Examiner* — Matthew Eason
(74) *Attorney, Agent, or Firm* — Vista IP Law Group, LLP

(57) ABSTRACT

A hearing aid includes: a first housing accommodating first circuitry; a second housing accommodating second circuitry; and a connector configured for interconnection of the first circuitry with the second circuitry; wherein the connector comprises a line for transmission of a first signal between the first circuitry and the second circuitry; wherein the second circuitry includes a transmitter configured for transmission of a second signal with configuration information to the first circuitry utilizing the line; and wherein the first signal does not contain the configuration information.

22 Claims, 3 Drawing Sheets

HEARING AID CONFIGURATION DETECTION

RELATED APPLICATION DATA

This application claims priority to and the benefit of Danish Patent Application No. PA 2014 70077, filed on Feb. 17, 2014, pending, and European Patent Application No. 14155375.0, filed on Feb. 17, 2014, pending. The entire disclosures of both of the above applications are expressly incorporated by reference herein.

FIELD OF TECHNOLOGY

The present disclosure relates to a new method for providing configuration information of a hearing aid, a hearing aid adapted to perform the method, and a system for fitting a hearing aid utilizing the configuration information.

BACKGROUND

BTE (behind-the-ear) hearings aids are well-known in the art. A BTE hearing aid has a BTE housing that is shaped to be worn behind the pinna of a user. The BTE housing accommodates components for hearing loss compensation. A sound signal transmission member, i.e. a sound tube or an electrical conductor, transmits a signal representing the hearing loss compensated sound from the BTE housing into the ear canal of the user.

The output transducer may be a receiver positioned in an ear canal of the user of the hearing aid, a so-called Receiver-In-the-Ear. In the following, a hearing aid with a Receiver-In-the-Ear is denoted a RIE hearing aid.

In a RIE hearing aid, the sound signal transmission member comprises electrical conductors for propagation of hearing loss compensated audio sound signals from the hearing aid circuitry in the BTE hearing aid housing through the conductors to the receiver positioned in the ear canal of the user for emission of sound towards the eardrum of the user.

In order to position the receiver securely and comfortably in the ear canal of the user, an in-the-ear housing, earpiece, shell, or earmould may be provided for insertion into the ear canal of the user.

In the following, the terms in-the-ear-housing, earpiece, shell, and earmould are used interchangeably.

Typically, hearing aid manufacturers provide a number of different earpieces with receivers having different output power specifications, e.g. 5 different output power levels.

Typically, earpieces are also provided having sound signal transmission members of different lengths, e.g. 8 different lengths, to suit the individual anatomy of the intended user.

Thus, e.g., 8*5=40 different earpieces may be used together with a specific BTE-housing.

Additionally, in order to fit the user's ear and secure the sound signal transmission member and other components in their intended position in the ear canal and prevent the earpiece from falling out of the ear, e.g., when the user moves the jaw, the earpiece, shell, or earmould may be individually custom manufactured or may be manufactured in a number of standard sizes, which further multiplies the number of earpieces that may be used together with a specific BTE-housing.

The earpiece may further accommodate one or more microphones, e.g. a microphone used for suppressing the occlusion effect and/or one or more microphones for recording directional cues further multiplying the number of earpieces that may be used together with a specific BTE-housing.

This results in a very large variety of earpieces that can be used together with a specific BTE-housing.

SUMMARY

Thus, a large variety of hearing aids may be provided by provision of different combinations of a smaller number of different subassemblies. Therefore, there is a need for automatic detection of the actual configuration of each hearing aid.

Thus, a new hearing aid is provided with a first housing accommodating first circuitry, a second housing accommodating second circuitry, and a connector configured for interconnection of the first circuitry with the second circuitry with a line for transmission of a first signal between the first circuitry and the second circuitry, and wherein the second circuitry includes a transmitter configured for transmission of a second signal with configuration information to the first circuitry utilizing the line, and wherein the first signal does not contain the configuration information.

The new hearing aid may be configured for adjusting its operation in accordance with the configuration information.

The second circuitry with the transmitter may be configured for transmission of the second signal with configuration information to the first circuitry at power up of the hearing aid; and/or upon the hearing aid receiving a user request for transmission of the second signal, from a user interface of the hearing aid; and/or upon the hearing aid receiving a request for transmission of the second signal, from external equipment, such as a fitting instrument.

A new method is also provided of identifying a component, or a combination of components, that is connected to a circuit with a connector, comprising transmitting configuration information on the identity of the component, or combination of components, on a line coupled with the connector and provided for transmission of other information than the configuration information.

A new method of hearing aid configuration, comprising using a connector to interconnect first circuitry with second circuitry with a line configured for transmission of a first signal, transmitting a second signal containing configuration information relating to the second circuitry on the line to the first circuitry, wherein the first signal does not contain the configuration information.

A new fitting instrument for a hearing aid is also provided, which is configured for reception of the configuration information.

The new fitting instrument may be configured for fitting the hearing aid in accordance with the configuration information.

The new fitting instrument may be configured for displaying a message in response to the configuration information.

The new fitting instrument may be a dedicated instrument, or a PC with suitable fitting software, a hand-held device, e.g. a tablet computer, a smartphone, etc., with suitable apps, etc.

With automatic identification of a component, or a combination of components, e.g. a receiver in an earpiece, maladjustment of the hearing aid in question is avoided.

For example, faster and safer initial fitting can be performed by the dispenser due to the automatic identification of component(s), e.g. a receiver type, during the initial fitting of the hearing aid to the intended user, e.g. inadvertently exchanged left and right in-the-ear housings may be automatically detected. The dispenser is also relieved of the task of manually entering configuration information during fitting, and incorrect gain calibrations and output levels due to erroneously manually entered component information are avoided.

Further, malfunctioning of the hearing aid due to inadvertent undesired combination of components, such as inadvertent interconnection of a wrong in-the-ear housing to a BTE-housing, is avoided. For example, a boot process of the hearing aid may be stopped when an undesired combination of components is detected, and/or certain functions of the hearing aid may only be enabled if a combination of components suitable for performing the functions is detected.

Yet further, correct replacement part numbers may be easily identified for the hearing aid in question.

Still further, a user of the hearing may be warned of an incorrect combination of components, such as when left ear and right ear components are unintentionally exchanged, e.g. when an in-the-ear housing intended for the right ear is inadvertently connected to the BTE-housing fitted for the left ear. A user may also be warned if wrong replacement parts are inadvertently delivered to the user and used with the hearing aid, whereby the user may be saved annoyance and possible extra visits to the dispenser's office.

The automatic identification is provided without increasing the number of conductors interconnecting the first and second circuitry, since the line used for transmission of the configuration information is already present for another purpose. In this way, existing hearing aid parts may be configured to perform the new method without hardware modification, such as modification of the connector. Also, complexity and cost of the connector is kept at a minimum.

The first signal may be an audio signal representing sound, for example an audio signal transmitted to a receiver for emission of the sound towards an eardrum of the user.

The second circuitry may include a power supply. The power supply may be energized through the line. For example, the power supply may be charged by transmitting a high frequency signal f>20 kHz on the line The power supply may be a capacitor.

The second circuitry may include a receiver. The line may be an input line of the receiver.

The transmitter may be configured for transmitting a signal with at least one varying signal parameter, such as amplitude, frequency, phase, pulse width, etc.

The transmitter may be configured for modulation of the line, such as by amplitude modulation, frequency modulation, phase modulation, etc.

The transmitter may be configured for digital modulation of the line, such as by phase-shift keying, frequency-shift keying, amplitude-shift keying, quadrature amplitude modulation, etc.

The configuration information may include information identifying the particular arrangement of parts or components interconnected with the first and/or second circuitry.

In particular, the configuration information may include an identifier of a component, and/or a combination of components, of the second circuitry.

The configuration information may include an identifier of a combination of components of the second circuitry.

The type and fitting parameters of the hearing aid may be strongly dependent on the component, or combination of components, of the second circuitry.

Therefore, it is important to provide the correct combination of first and second circuitry of the hearing aid and fitting parameters of the hearing aid, for a specific user.

An incorrect combination may result in a significant maladjustment of the hearing aid.

The transmitter may be configured for transmitting the configuration information by short-circuiting the line. The short-circuiting may cause corresponding voltage drops of the battery supply voltage that may be detected and decoded by the first circuitry, for example by a signal processor, e.g. a signal processor configured for performing hearing loss compensation, of the first circuitry, whereby the one component, or the combination of components, of the second circuitry is identified in the first circuitry.

The first housing may be a behind-the-ear housing and the second housing may be an earpiece.

The second circuitry may have a microcontroller programmed to short-circuit the line in accordance with an encoded time sequence for identification of the one component, or the combination of components, of the second circuitry.

RIE hearing aids may be provided with a connector for easy connection and disconnection of the second circuitry of second housing, such as an earpiece, to the first circuitry of the first housing, such as a BTE housing. For example, in this way, various types of receivers in earpieces may easily be connected to a BTE housing thereby providing different hearing aids with different receivers.

The new fitting instrument may automatically respond to received configuration information, e.g., by selecting hearing aid parameters in accordance with the received configuration information, e.g. a specific model of receiver identified. In this way, the receiver, the hearing aid and the hearing aid fitting parameters are combined correctly.

The operator of the new fitting instrument may take appropriate action in response to a display of the configuration information, e.g., by adjusting hearing aid parameters in accordance with the configuration information, e.g. a specific model of receiver identified. In this way, the receiver, the hearing aid and the hearing aid fitting parameters are combined correctly.

The operator of the new fitting instrument may take appropriate action in response to a display of the configuration information, e.g., by replacing the receiver, which is appropriate in case adjustment of the hearing aid to the specific model of receiver identified is not possible. In this way, undesired combinations of receiver, hearing aid and hearing aid fitting parameters can be discovered and corrected.

Adjustment of the hearing aid and hearing aid parameters may be controlled internally by said hearing aid.

Throughout the present disclosure, the "audio signal" may be used to identify any analogue or digital signal forming part of a signal path from an input to an output of the hearing aid.

Signal processing in the new hearing aid and in the new fitting instrument may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing aid includes: a first housing accommodating first circuitry; a second housing accommodating second circuitry; and a connector configured for interconnection of the first circuitry with the second circuitry; wherein the connector comprises a line for transmission of a first signal between the first circuitry and the second circuitry; wherein the second circuitry includes a transmitter configured for transmission of a second signal with configuration information to the first circuitry utilizing the line; and wherein the first signal does not contain the configuration information.

Optionally, the first signal is an audio signal representing sound.

Optionally, the second circuitry includes a power supply that is charged with a third signal transmitted on the line.

Optionally, the second circuitry includes a receiver.

Optionally, the line is an input line of the receiver.

Optionally, the transmitter is configured for transmitting the second signal with at least one varying signal parameter selected from the group consisting of amplitude, frequency, phase, and pulse width.

Optionally, the second signal is modulated, and wherein the modulation is selected from the group consisting of amplitude modulation, frequency modulation, and phase modulation.

Optionally, the second signal is modulated digitally, and wherein the digital modulation is selected from the group consisting of phase-shift keying, frequency-shift keying, amplitude-shift keying, and quadrature amplitude modulation.

Optionally, the transmitter is configured for transmitting the second signal by short-circuiting the line.

Optionally, the configuration information includes an identifier of one or more components in the second circuitry.

Optionally, the configuration information includes a plurality of identifiers of respective components in the second circuitry.

Optionally, the first housing is a behind-the-ear housing, and the second housing is an in-the-ear housing.

A fitting instrument for the hearing aid is configured for reception of the configuration information.

Optionally, the fitting instrument is configured for fitting the hearing aid based on the configuration information.

Optionally, the fitting instrument is configured for displaying a message in response to the configuration information.

A method of configuring a hearing aid having a connector that interconnects first circuitry of the hearing aid with second circuitry of the hearing aid, the connector having a line configured to transmit a first signal between the first circuitry and the second circuitry, the method includes: transmitting a second signal containing configuration information relating to the second circuitry to the first circuitry using the line; wherein the first signal does not contain the configuration information.

Other and further aspects and features will be evident from reading the following detailed description of the embodiments.

BRIEF DESCRIPTION OF THE DRAWINGS

Below, the new method, hearing aid, and fitting instrument are explained in more detail with reference to the drawings in which various examples are shown. In the drawings.

DETAILED DESCRIPTION

Figure 1:
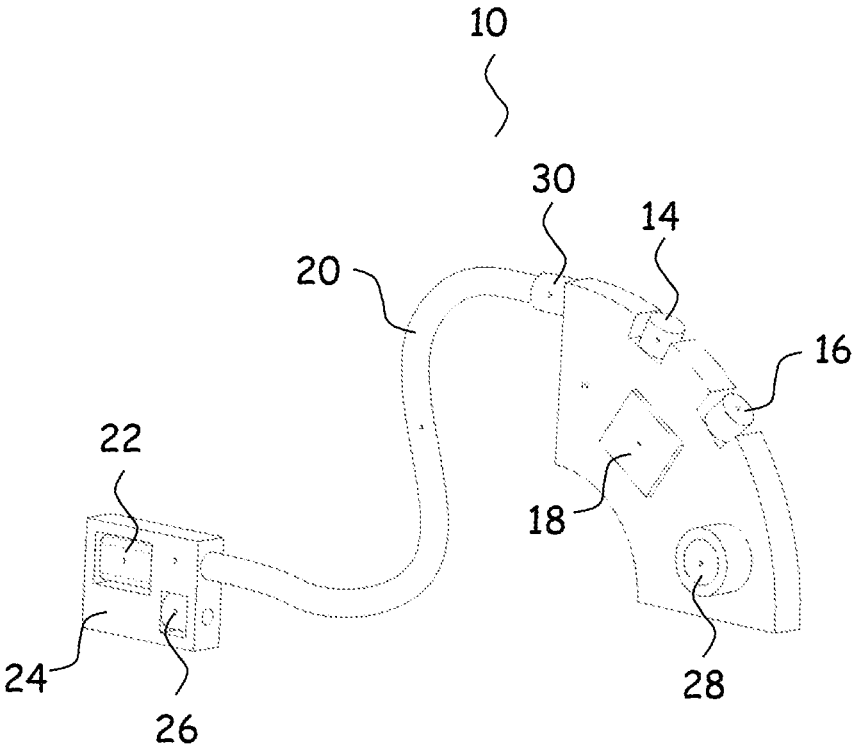
FIG. 1 schematically illustrates an exemplary new hearing aid.

The new method, hearing aid, and fitting instrument will now be described more fully hereinafter with reference to the accompanying drawings, in which various examples of the new method, hearing aid, and fitting instrument are shown. The new method, hearing aid, and fitting instrument may, however, be embodied in different forms and should not be construed as limited to the examples set forth herein.

It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Like reference numerals refer to like elements throughout. Like elements will, thus, not be described in detail with respect to the description of each figure.

Figure 2:
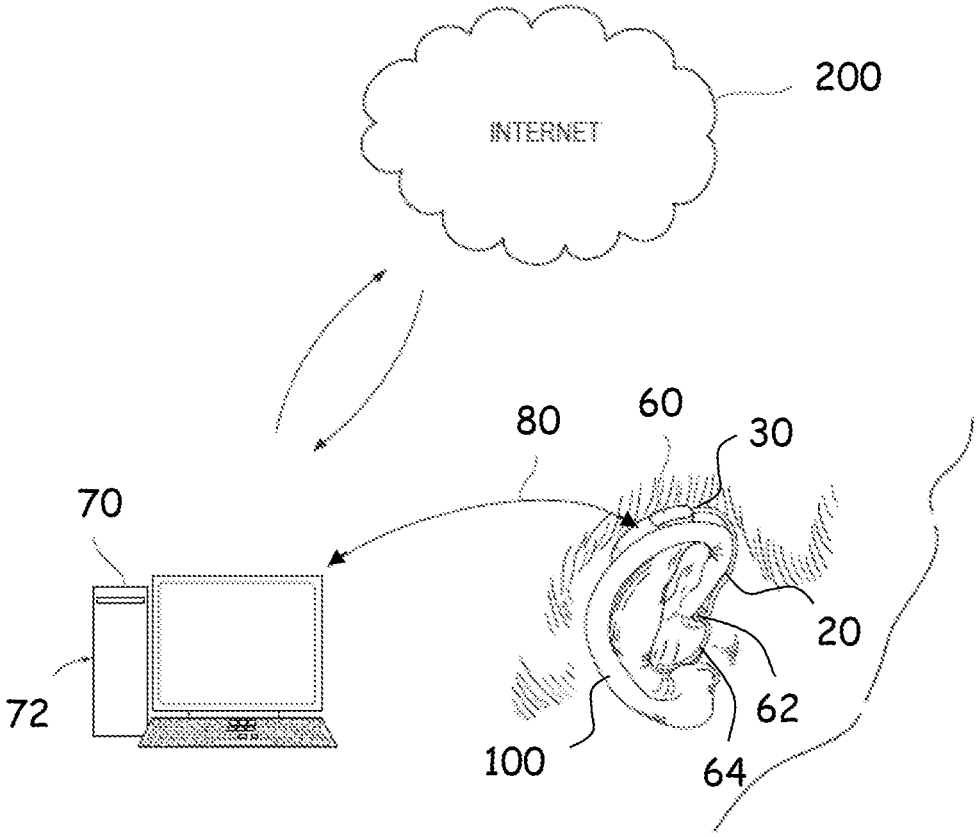
FIG. 2 shows in perspective a new RIE type hearing aid.
Figure 3:
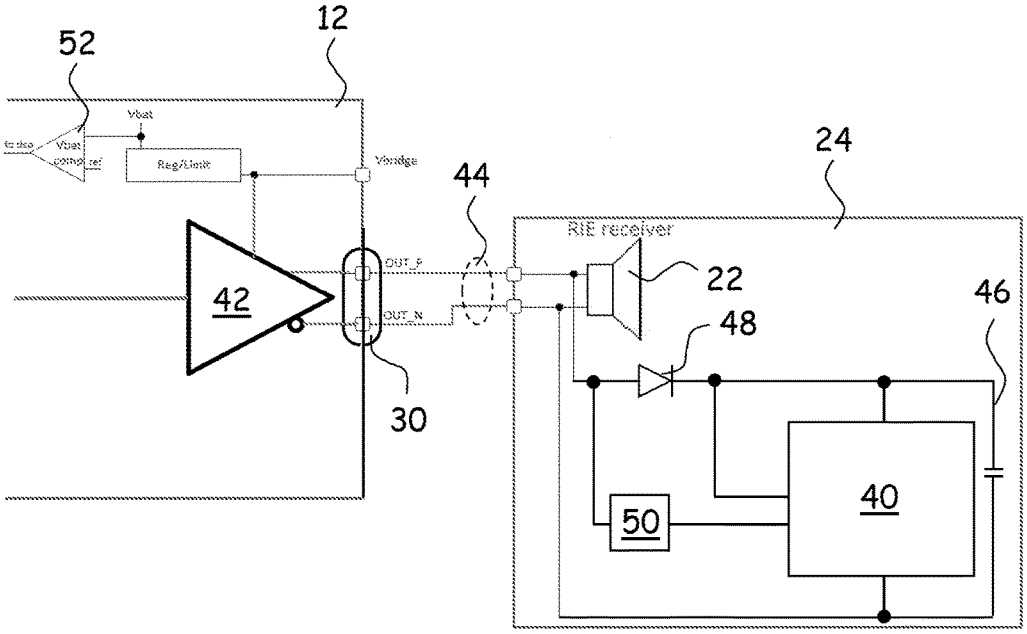
FIG. 3 shows hearing aid circuitry for automatic configuration detection.

FIGS. 1-3, and in particular FIG. 1, schematically illustrates a RIE hearing aid 10 comprising a first housing, namely a BTE hearing aid housing (not shown—outer walls have been removed to make internal parts visible), to be worn behind the pinna 100 of a user. The BTE housing accommodates first circuitry 12 with at least one BTE sound input transducer 14, 16, namely a front microphone 14 and a rear microphone 16 for conversion of an acoustic sound signal into respective microphone audio sound signals, optional pre-filters (not shown) for filtering the respective microphone audio sound signals, A/D converters (not shown) for conversion of the microphone audio sound signals into respective digital microphone audio sound signals that are input to a processor 18 configured to generate a hearing loss compensated output signal based on the input digital audio sound signals.

The hearing loss compensated output signal is transmitted through a line 44 (not visible) with electrical wires contained in a sound signal transmission member 20 to a receiver 22 of second circuitry 24 accommodated in a second housing (not shown—outer walls have been removed to make internal parts visible). The receiver 22 provides an acoustic output signal for transmission towards the eardrum of the user, based on the hearing loss compensated output signal. The second housing constitutes an earpiece 62 with an outer shape that is configured to be comfortably positioned in the ear canal of the user for fastening and retaining the receiver 22 and the sound signal transmission member 20 in their intended positions in the ear canal of the user as is well-known in the art of BTE hearing aids.

The earpiece 62 with the sound transmission member 20 is connected to the BTE housing with a connector 30 for easy connection and removal of the earpiece 62.

The earpiece 62 comprises the sound transmission member 20. A large number of different earpieces may be connected to the BTE housing with the connector 30, such as with earpieces accommodating a) one receiver and zero microphones,
b) one microphone and zero receivers,
c) one receiver and one microphone positioned for preservation of directional cue,
d) one receiver and one microphone positioned for suppressing occlusion,
e) one receiver and two microphones (directional cue and occlusion), etc.

The above-mentioned earpieces may further have receivers with different power ratings, e.g. 4 different ratings, and may further have sound tube members 20 of different lengths, e.g. 5 different standard lengths.

Still further, earpieces are provided configured for the left ear and earpieces are provided configured for the right ear.

Yet still further, some earpieces may be provided with other sensors, such as temperature sensors, pressure sensors, directional sensors, etc.

Thus, a large variety of ear pieces may easily be provided; and thus, automatic detection of the ear piece actually connected to the BTE housing with the connector 30 is highly advantageous, e.g. in order to avoid mistakes.

The earpiece 62 shown in the figures accommodates one In-the-Ear (ITE) microphone 26 that is positioned at the entrance to the ear canal when the earpiece 62 is positioned in its intended position in the ear canal of the user. The ITE microphone 26 is connected to an A/D converter (not shown) and optionally to a pre-filter (not shown) in the BTE housing, with interconnecting electrical wires (not visible) contained in the sound transmission member 20.

The BTE hearing aid 10 is powered by battery 28. The battery 28 may be rechargeable.

In use, the ITE microphone 26 is positioned at an entrance to an ear canal of the user. In this position, the output signal of the ITE microphone, in the following denoted the ITE audio sound signal, generated by the ITE microphone 26 in response to acoustic sound received by the ITE microphone 26, preserves spatial cues of the received acoustic sound signal; or, in other words, the ITE microphone 26 is positioned so that its transfer function constitutes a good approximation to the Head Related Transfer Functions of the user.

The processor 18 conveys the directional information contained in the ITE audio sound signal to the hearing loss compensated output signal thereby also preserving spatial cues so that the user maintains his or her localization capability.

The ITE microphone 26 operates proximate the receiver 22 so that risk of feedback is high, which limits the maximum stable gain available with the hearing aid 10.

However, in the hearing aid 10, output signals of the microphones 14, 16 and the ITE microphone 26 are subjected to signal processing, e.g. adaptive filtering as for example explained in more detail in European patent application No.: 12199761.3, in such a way that spatial cues are preserved and conveyed to the user of the hearing aid while feedback is simultaneously suppressed.

As mentioned above, a microphone may be accommodated in the second housing, i.e. in the earpiece 62, for suppressing occlusion. The microphone is positioned inside the ear canal proximate the ear drum when the earpiece 62 is positioned in its intended position in the ear canal of the user.

Typically, occlusion of the ear canal by the second housing (earpiece) leads to an altered user perception of the user's own voice.

Sounds originating from the vocal tract (throat and mouth) are transmitted into the ear canal through the cartilaginous tissue between these cavities and the outer portion of the ear canal.

When nothing is positioned in the ear canal, most of this predominantly low frequency sound simply escapes from the ear canal. However, when the ear canal is blocked these bone-conducted sounds cannot escape from the ear canal. The result is a build-up of high sound pressure levels in the residual ear canal volume. This increase in low frequency sound pressure is audible and will cause them to hear their own voice as loud and boomy. Change in perception of own voice is the most dominant occlusion related complaint, but not the only one. Other occlusion related problems include too much amplification at low frequencies for hearing aid users with good low frequency hearing, reduced speech intelligibility, poorer localization, physical discomfort and increased risk of external ear irritation and infection. Hearing aid users do not adapt to occlusion and the occlusion effect has been cited by as many as 27% of hearing aid wearers as a reason for dissatisfaction with their hearing aids. This emphasizes the need for alleviating or, even better, eliminating the occlusion effect.

As explained in more detail in EP 2 434 780 A1, the receiver may compensate for the body conducted sound based on an output signal of the microphone positioned proximate the ear drum when the earpiece is positioned in its intended position in the ear canal of the user, so that the user perceives to listen to the hearing loss compensated signal only, whereby the occlusion effect is suppressed.

FIG. 2 shows the new hearing aid 10 in its operating position with the BTE housing 60 behind the ear, i.e. behind the pinna 100, of the user. As illustrated, the new hearing aid 10 may have an arm 64 that is flexible and intended to be positioned inside the pinna 100, e.g. around the circumference of the conchae behind the tragus and antitragus and abutting the antihelix and at least partly covered by the antihelix for retaining the earpiece 62 in its intended position inside the outer ear of the user. The arm may be pre-formed during manufacture, preferably into an arched shape with a curvature slightly larger than the curvature of the antihelix, for easy fitting of the arm into its intended position in the pinna 100.

FIG. 2 also schematically illustrates a new fitting instrument 70 and its wireless interconnections with the Internet 200 and the new BTE hearing aid 10 shown in its operating position with the BTE housing 60 behind the ear, i.e. behind the pinna 100, of the user.

Configuration information may be transmitted wirelessly 80 to the fitting instrument 70, e.g. to be displayed on a display of the fitting instrument 70 for verification by the operator of the fitting instrument 70, and possible corrective action in the event that the detected type of earpiece is not of the desired type.

The fitting instrument 70 is configured for fitting the hearing aid 10 in accordance with the configuration information.

The fitting instrument 70 has a processor 72 that is configured for responding to the configuration information received from the hearing aid 10.

The fitting instrument may be configured to access a remote server through the Internet 200, e.g. to access a data base for further information on the hearing aid 10, e.g. based on the received configuration information, e.g. with new values of fitting parameters relating to a new type of earpiece 62.

FIG. 3 shows a block diagram of the hearing aid circuitry 12, 24 for automatic configuration detection. In FIG. 3, the second circuitry 24 is accommodated in the second housing, i.e. the earpiece 62; however, in another example, the second circuitry 24 may be accommodated in the connector 30.

The second circuitry 24 comprises the receiver 22 and a transmitter 40 in the form of a microcontroller 40 configured for transmission of a code that uniquely identifies the type of ear piece 62 with the second circuitry 24, e.g. the transmitted code contains the configuration information, e.g. the power rating of the receiver 22, whether the ear piece 62 is for the left ear or the right ear, and possibly the length of the sound transmission member 20, and possibly the number and types (occlusion and/or spatial cue) of microphones 26, and possibly the number and types of other sensors, etc.

The receiver 22 is driven by receiver driver 42 accommodated in the first housing, namely the BTE-housing 60. During normal operation of the hearing aid 10, the receiver driver 42 transmits the hearing loss compensated sound signal to the receiver on line 44 in the sound transmission member 20.

During boot-up of the hearing aid 10, the receiver driver 42 transmits a high frequency signal, preferably of a frequency above 20 kHz, on line 44. The high frequency signal charges capacitor 46 through diode 48, and the charged capacitor 46 subsequently supplies power to the transmitter (microcontroller) 40 during transmission of the code on line 44.

The high frequency signal is further low pass filtered in low pass filter 50 and input to the microcontroller 40 that is configured for detection of presence of the high frequency signal. The microcontroller 40 is further configured for transmission of the code on line 44 upon seizure of the high frequency signal.

The microcontroller 40 is configured for transmission of the code by intermittently short-circuiting line 44 thereby generating a series of voltage drops of the supply voltage of the circuitry in the BTE housing that is detected by a comparator 52 of the first circuitry 12 in the BTE housing 60 already present for monitoring the voltage supply of the circuitry.

Thus, the code is transmitted and decoded using signal lines for transmission of an audio signal to the receiver, always present in a hearing aid, and without adding circuitry in the BTE housing.

The second circuitry 24 may be configured to transmit the configuration information repeatedly until power is no longer available from the power supply of the second circuitry, e.g. charged capacitor 46, or, the second circuitry 24 may be configured to transmit the configuration information repeatedly until receipt of an acknowledge signal from the first circuitry that the configuration information has been successfully received, e.g. by emission of the high frequency signal for a predetermined time period.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents, as defined by the claims.

The invention claimed is:

1. A hearing aid comprising:

a first housing accommodating first circuitry;

a second housing accommodating second circuitry; and a connector configured for interconnection of the first circuitry with the second circuitry;

wherein the connector comprises a line for transmission of a first signal between the first circuitry and the second circuitry;

wherein the second circuitry includes a component configured to provide a second signal with configuration information for transmission to the first circuitry utilizing the line; and wherein the first signal comprises an audio signal representing sound.

2. The hearing aid according to claim 1, wherein the second circuitry includes a power supply that is charged with a third signal transmitted on the line.

3. The hearing aid according to claim 1, wherein the second circuitry includes a receiver.

4. The hearing aid according to claim 3, wherein the line is an input line of the receiver.

5. The hearing aid according to claim 1, wherein the component is configured to provide the second signal with at least one varying signal parameter selected from the group consisting of amplitude, frequency, phase, and pulse width.

6. The hearing aid according to claim 1, wherein the second signal is modulated, and wherein the modulation is selected from the group consisting of amplitude modulation, frequency modulation, and phase modulation.

7. The hearing aid according to claim 1, wherein the second signal is modulated digitally, and wherein the digital modulation is selected from the group consisting of phase-shift keying, frequency-shift keying, amplitude-shift keying, and quadrature amplitude modulation.

8. The hearing aid according to claim 1, wherein the component is configured for short-circuiting the line to utilize the line for transmitting the second signal.

9. The hearing aid according to claim 1, wherein the configuration information includes an identifier of one or more components in the second circuitry.

10. The hearing aid according to claim 1, wherein the configuration information includes a plurality of identifiers of respective components in the second circuitry.

11. The hearing aid according to claim 1, wherein the first housing is a behind-the-ear housing, and the second housing is an in-the-ear housing.

12. A fitting instrument for the hearing aid of claim 1, configured for reception of the configuration information.

13. The fitting instrument according to claim 12, configured for fitting the hearing aid based on the configuration information.

14. The fitting instrument according to claim 12, configured for displaying a message in response to the configuration information.

15. A method of configuring a hearing aid having a connector that interconnects first circuitry of the hearing aid with second circuitry of the hearing aid, the connector having a line configured to transmit a first signal between the first circuitry and the second circuitry, the method comprising:

transmitting a second signal containing configuration information relating to the second circuitry to the first circuitry using the line;

wherein the first signal comprises an audio signal representing sound.

16. The hearing aid according to claim 1, wherein the component comprises a microcontroller.

17. The hearing aid according to claim 16, wherein the second circuitry comprises a capacitor coupled to the microcontroller.

18. The hearing aid according to claim 1, further comprising a low pass filter coupled to the component.

19. A hearing aid comprising:

a first housing accommodating first circuitry;

a second housing accommodating second circuitry; and a connector configured for interconnection of the first circuitry with the second circuitry;

wherein the connector comprises a line for transmission of a first signal between the first circuitry and the second circuitry, the first signal comprising an audio signal representing sound; and wherein the hearing aid further comprises a component configured to provide a second signal with configuration information for transmission to the first circuitry utilizing the line.

20. The hearing aid of claim 19, wherein the component is external to the second housing that accommodates the second circuitry.

21. The hearing aid of claim 19, wherein the component is at the connector.

22. The hearing aid of claim 19, wherein the component is a part of the second circuitry.

* * * * *